United States Patent [19]

Ott

[11] Patent Number: 4,589,384

[45] Date of Patent: May 20, 1986

[54] ROCKER ARM LIFTER ASSEMBLY

[76] Inventor: Vern D. Ott, 1839 Rt. 746 S., Cardington, Ohio 43315

[21] Appl. No.: 640,756

[22] Filed: Aug. 14, 1984

[51] Int. Cl.[4] ..... F01L 1/14; F01L 1/24

[52] U.S. Cl. ..... 123/90.55; 123/90.61

[58] Field of Search ..... 123/90.48, 90.52, 90.55, 123/90.61, 90.62

[56] References Cited

U.S. PATENT DOCUMENTS

| | | | |
|---|---|---|---|
| 1,500,901 | 7/1924 | Sevigne | 123/90.6 |
| 1,770,730 | 7/1930 | Brownback | 123/90.48 |
| 1,874,471 | 8/1932 | Du Bois | 123/90.52 |
| 2,067,114 | 1/1937 | Ashton | 123/90.61 |
| 2,346,737 | 4/1944 | Essl | 123/90.55 |
| 2,404,478 | 7/1946 | Engemann | 123/90.61 |
| 2,634,714 | 5/1953 | Randol | 123/90.55 |
| 2,746,436 | 5/1956 | Harvey | 123/90.55 |
| 2,809,618 | 10/1957 | Clubb et al. | 123/90.61 X |
| 2,812,750 | 11/1957 | Lesher | 123/90.55 |
| 2,865,352 | 12/1958 | Thompson | 123/90.55 X |
| 3,132,636 | 5/1964 | Kliss | 123/90.52 |
| 3,450,228 | 6/1969 | Wortman et al. | 123/90.55 |
| 3,699,934 | 10/1972 | Gaipo et al. | 123/90.61 X |
| 3,717,134 | 2/1973 | Cornell | 123/90.55 |
| 3,875,911 | 4/1975 | Joseph | 123/90.55 X |
| 4,186,696 | 2/1980 | Linsenmann | 123/90.61 |
| 4,231,267 | 11/1980 | Van Slooten | 123/90.48 X |

*Primary Examiner*—William R. Cline
*Assistant Examiner*—Peggy A. Neils
*Attorney, Agent, or Firm*—Sidney W. Millard

[57] ABSTRACT

A valve lifter assembly for a pushrod-operated internal combustion engine has a housing provided with a novel system of oilways which allow separate lubrication of each of two cylinders within which the tappets slide. The tappets comprise a body member, a hydraulic lifter disposed within a socket in the body member and a cap above the hydraulic lifter, the tappet being so designed that the socket on the cap which receives the lower end of the pushrod actually lies within the body member. The valve lifter assembly has a pushrod in which the threaded section of the adjusting member has a pair of flat, parallel surfaces on opposed sides thereof so that the threaded section, rather than a separate hexagonal section, can be grasped by a wrench for adjustment of the length of the pushrod.

9 Claims, 9 Drawing Figures

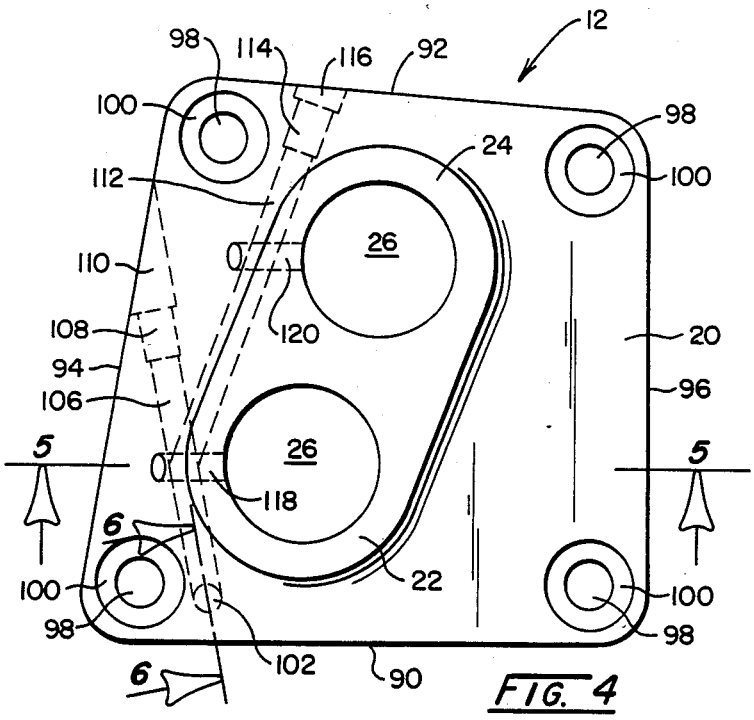
FIG. 4
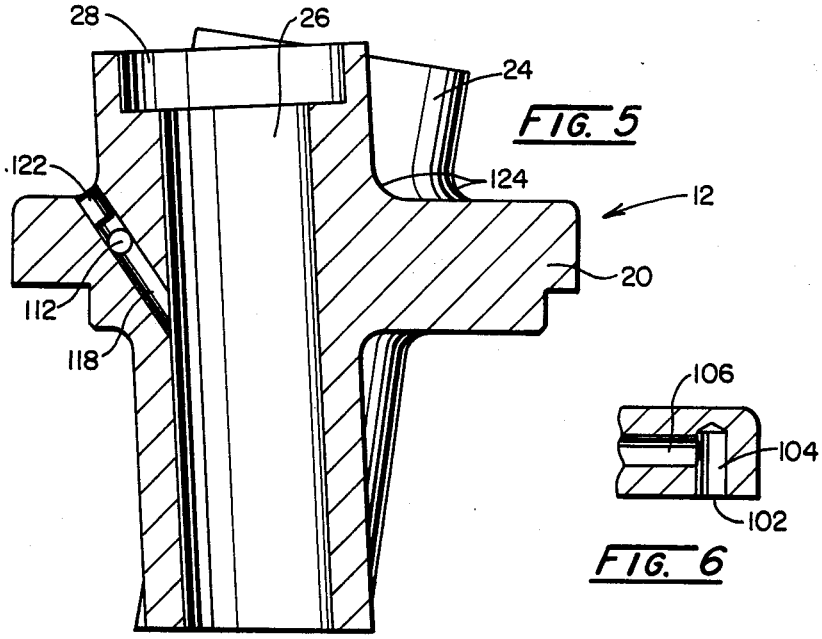
FIG. 5
FIG. 6

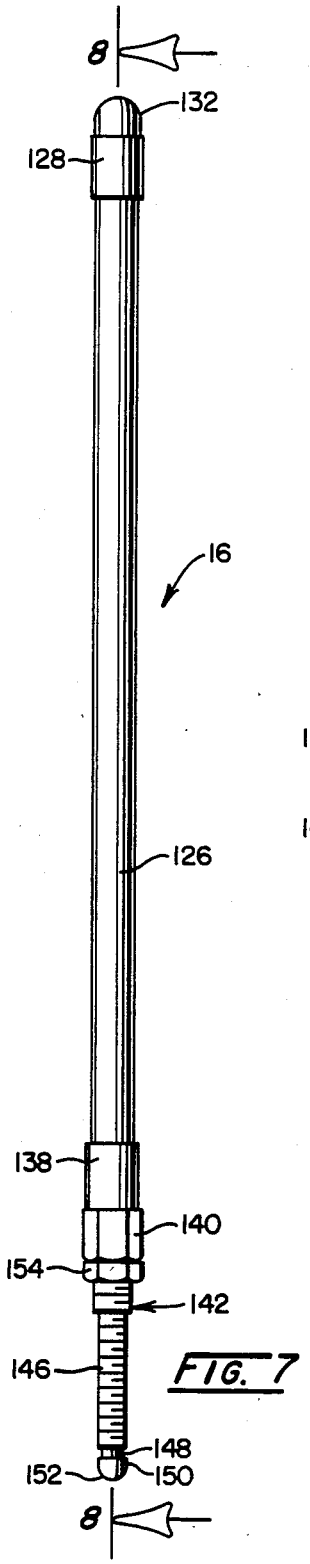
FIG. 7
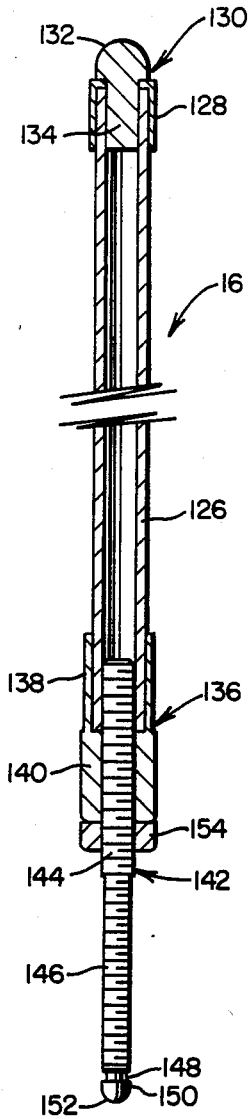
FIG. 8
FIG. 9
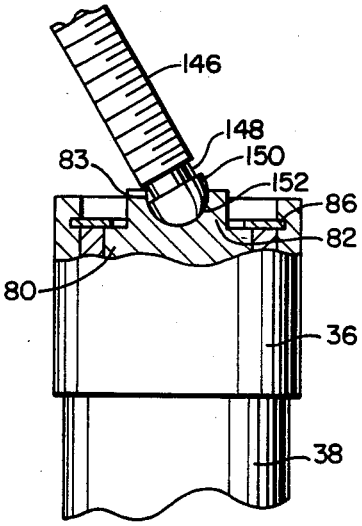

ROCKER ARM LIFTER ASSEMBLY

BACKGROUND OF THE INVENTION

This invention relates to rocker arm lifter assemblies. More particularly, this invention relates to rocker arm lifter assemblies of a type commonly used in motorcycle engines in which the pushrod of the rocker arm lifter assembly is not coaxial with the remainder of the lifter assembly.

Conventional pushrod-operated motorcycle engines, such as those manufactured by Harley Davidson Corporation, use a valve lifter assembly comprising a housing in the form of an approximately trapezoidal flange having two hollow cylindrical sections integral with and extending through the flange. The hollow interiors of the cylindrical sections, which are inclined at a slight angle to one another, each accommodate a pushrod lifter (or tappet) the lower end of which is in contact with a cam. These tappets incorporate hydraulic lifters arranged to maintain proper valve clearances as the engine warms up. The upper end of each tappet lifter is in contact with the lower end of the pushrod, the upper end of the pushrod being in contact with the rocker arm. The pushrods are adjustable in length to allow for adjustment of valve clearances and to enable the pushrods to be inserted into and removed from the valve lifter assembly.

In this type of valve lifter assembly, each tappet has three main parts, the first of which is a hollow cylindrical body member closed at its lower end and carrying at its lower end a roller which is in contact with the cam. Within the hollow interior of this body member is accommodated the cylinder of a hydraulic lifter. The upper end of this hydraulic lifter cylinder has a radially-outwardly extending flange which abuts against the upper end of the body member to hold the hydraulic lifter cylinder in its correct position. The third and uppermost part is in three cylindrical sections. The lowest section constitutes the piston of the hydraulic lifter and slides within the cylinder. The middle section is of smaller diameter than the lower section, while the third and uppermost section is of larger diameter than the middle section and is provided with a socket with accommodates the rounded end of the pushrod. A helical spring is wrapped around the middle section, this spring being retained in position by the shoulders occurring where the middle section meets the other two sections. However, this helical spring is made slightly larger in diameter than the piston section so that when the three parts are assembled the lower end of the spring abuts the flange at the upper end of the hydraulic lifter cylinder. This type of tappet suffers from the disadvantage that the section of the third part carrying the socket has to protrude a considerable distance above the upper ends of the body member and cylinder in order to accommodate the spring, and the socket section is connected to the piston section only by the relatively thin and flexible middle section. Accordingly, since the design of the engine requires that the pushrod be inclined to the axis of the pushrod lifter, and because the piston is driven downwardly by the considerable force exerted by the valve closing spring as the valve closes, considerable flexing of the middle section occurs, resulting in an undesirable degree of vibration and noise from the engine, especially at high engine speeds. These problems of vibration and noise are exacerbated by the conventional pushrods, which are made of steel and are relatively heavy, so that there is a great deal of inertia to overcome as the pushrod oscillates up and down.

In order to reduce these vibration and noise problems, it might, prima facie, appear desirable to reduce the extent to which the socket-carrying portion of the third part protrudes above the upper ends of the body member and cylinder. However, not only would reduction of the projection of the third part above the upper ends of the body member cylinder cause difficulties in formation of a suitable spring, but the design of the conventional pushrod also makes it difficult to reduce this projection. The conventional pushrod comprises a long shaft having a rounded upper end which engages the rocker arm and a lower hexagonal section having threaded socket formed in its lower end. An adjusting member having a threaded upper section is screwed into the socket. Immediately adjacent the threaded section, the adjusting member has a section formed as a hexagonal nut and, below this nut section, a short cylindrical section the lower end of which is capped by a hemispherical section which engages the socket on the pushrod lifter. A locknut is screwed onto the threaded section of the adjusting member and can be engaged with the lower end of the shaft to lock the adjusting member and shaft in position relative to one another.

To insert this type of pushrod into position in the engine, the adjusting member is screwed into the socket in the shaft so as to reduce the length of the pushrod to a value which is less than that between the socket on the pushrod lifter and the rocker arm, so that the pushrod can be inserted between the pushrod lifter and rocker arm. The hexagonal section on the shaft and the nut section on the adjusting member are then grasped with wrenches, and the adjusting member rotated relative to the shaft until the length of the pushrod has been adjusted to the proper value. Next, while the shaft and adjusting member are being held in the correct relative position by the two wrenches already mentioned, a third wrench is applied to the locknut and the locknut rotated until it engages the lower end of the shaft, thereby locking the pushrod at its correct length.

In order that the pushrod can be adjusted to the correct length during this process, it is thus essential that the nut section on the adjusting member be accessible throughout the assembly process in order that the adjusting member can be held in the correct position relative to the shaft, and thus the correct length of the pushrod maintained, until the locknut has been engaged with the lower end of the shaft, thus locking the pushrod at its correct length. Unfortunately, final adjustment of the length of the pushrod to the correct length, which sets the clearance of the valve associated with the pushrod, must of necessity be performed with the valve in its closed position, and obviously when the valve is closed the pushrod and its associated tappet will be at their lowest positions relative to the housing. For obvious reasons, including the need to keep the relatively heavy tappet as light as possible, and the need for accurate, high-speed movement of the tappet within the cylindrical section of the housing, when the tappet is at its lowest position relative to the housing, the upper ends of the body member and cylinder lie a considerable distance below the upper end of the associated cylindrical section of the housing, and are thus inaccessible to wrenches. It is only the projection of the socket-carrying section of the third part of the tappet above the upper end of the cylindrical section of the flange that renders the nut section at the lower end of the adjusting member accessible to a wrench during final adjustment of the pushrod length. Accordingly, reduction or elimination of the projection of the socket-carrying portion of the third part above the upper ends of the body member and cylinder of the tappet cannot be achieved without considerable modification of the design of the pushrod.

Also, the cylindrico-hemispherical section at the lower end of the adjusting member, coupled with the inclination of the axis of the pushrod to the axis of the tappet, tends to cause contact of the cylindrical part of this lower end of the adjusting member with the lip of the socket at the upper end of the tappet, further increasing the noise and vibration from this type of valve lifter assembly.

Finally, lubrication of the tappets as they slide up and down within the cylindrical sections of the housing presents a problem in this type of valve lifter assembly. Because of the engine design, entry of oil into the housing has to occur at a small port located on the underside of the flange between one of the cylindrical sections and an adjacent edge of the flange. Hitherto, lubrication of the tappet in the cylindrical section adjacent the inlet port has been achieved by providing an oilway which extends up from the inlet port and then approximately horizontally through the flange into the bore of this cylindrical section. Lubrication of the bore in the other cylindrical section is achieved by a bore which passes through the wall dividing the bores in the two cylindrical sections. In practice, this frequently results in inadequate lubrication of the bore in the cylindrical section remote from the oil inlet port, since relatively little oil makes its way into the bore connecting the two cylindrical sections, and in any case this bore tends to become clogged with dirt after protracted use of the engine.

Accordingly, there is a need for modifications of the valve lifter assemblies used in such pushrod-operated motorcycle engines to overcome the aforementioned disadvantages, and this invention seeks to provide such modifications.

SUMMARY OF THE INVENTION

This invention provides a modified adjustable-length pushrod, a modified housing and a modified pushrod lifter assembly (or tappet) for use in pushrod-operated motorcycle engines of the type described above.

Like the conventional adjustable-length pushrod described above, the instant pushrod comprises a shaft having at one end an internally screw-threaded socket, and an adjusting member having a screw-threaded section extending from its one end, this screw-threaded section being engageable with the socket so that one end of the adjusting member can be screwed into and out of the socket, thereby enabling the length of the pushrod to be adjusted. Also, the adjusting member has, at its opposed end, a non-threaded section having a bearing surface for engagement with a tappet. However, in the instant adjustable-length pushrod, the threaded section of the adjusting member has a pair of substantially flat, parallel surfaces on opposed sides thereof so that these flat, parallel surfaces can be grasped by a wrench and the adjusting member rotated by the wrench. Obviously, such rotation of the adjusting member enables the length of the pushrod to be varied.

The instant housing, is like the conventional housing described above, intended to accommodate two tappets and comprises a flange having first, second and third edges, and first and second hollow cylindrical sections integral with the first and third edges lying on opposed sides of the flange and the second edge connecting the first and third edges, and extending through the flange, the first cylindrical section lying adjacent the first edge of the flange and the second cylindrical section adjacent the third edge of the flange. Also, as in the conventional housing described above, the instant housing has an oil inlet in the underside of the flange between the first cylindrical section and the first edge of the flange. However, the instant housing differs from the conventional housing already described in the oilways or conduits provided for lubrication of the two cylindrical sections. In the instant housing, a first conduit extends upwardly from the oil inlet into the flange, a second conduit extends from the first conduit to the second edge of the flange, a third conduit extends from the second conduit to the third edge of the flange, a fourth conduit extends from the upper face of the flange to the interior of the front hollow cylindrical section and intersects at least of the second and third conduits, and a fifth conduit extends from the upper face of the flange to the interior of the rear hollow cylindrical section and intersects the third conduit. To prevent escape of oil at the points where the second, third, fourth and fifth conduits emerge from the surfaces of the flange, the instant housing is provided with plugging means which block the second conduit between its intersection with the third conduit and the second edge of the flange, which block the third conduit between its intersection with the fifth conduit and the third edge of the flange, which block the fourth conduit between the upper surface of the flange at its intersection with the second and/or third conduits and which block the fifth conduit between the upper surface of the flange at its intersection with the third conduit.

The instant pushrod lifter assembly or tappet comprises a body member which is generally similar to the body member of conventional tappets having, at its lower end, a bearing surface for engaging a cam, the body member also having a socket closed at its base but open to the upper end of the body member. The instant pushrod lifter assembly further comprises a hydraulic lifter slideably disposed within the socket of the body member. This hydraulic lifter has a hollow cylinder member closed at its lower end and disposed at the lower end of the hydraulic lifter so as to leave a chamber between the lower end of the hollow cylinder member and the lower end of the socket in the body member. A conduit is provided in the hollow cylinder member extending from this chamber into the interior of the hollow cylinder member and a check valve is disposed in this conduit so as to permit fluid flow from the chamber via the conduit into the interior of the hollow cylinder member but not in the reverse direction. The hydraulic lifter further comprises a piston slideably received within and closing the upper end of the hollow interior of the hollow cylinder member. Biasing means, such as the spring, are provided for biasing the lower end of the hollow cylinder member away from the lower end of the socket in the body member so as to maintain the presence of the aforementioned chamber, and means are provided for supplying oil to the chamber. A cap member is slideably mounted on the piston of the hydraulic lifter, this cap member being provided with a socket for receiving the lower end of a pushrod.

Throughout this application, terms such as "front", "rear", "left", "right", "upper" and "lower" and the like may be used merely to define relative position and orientations of the various parts of the instant pushrod, housing and pushrod lifter assembly. Such terms refer to the positions and orientations in which the various parts are located on a conventional pushrod-operated motorcycle engine, but the claims of this application extend to the instant pushrod, housing and pushrod lifter assembly regardless of their orientation at any given time, and regardless of the manner in which they happen to be disposed upon any particular engine.

BRIEF DESCRIPTION OF THE DRAWINGS

FIG. 4 is a top plan view of the housing shown in FIG. 1;

FIG. 5 is a section along the line 5—5 in FIG. 4, and shows the same view of the housing as in FIG. 1 but on a larger scale;

FIG. 6 is a section along the line 6—6 in FIG. 4;

FIG. 7 is an elevation of the pushrod shown in FIG. 1;

FIG. 8 is a section along the line 8—8 in FIG. 7, this section being taken in a plane through the axis of the pushrod; and FIG. 9 is a enlarged view of the upper end of the tappet and the lower end of the pushrod shown in FIG. 1, with the upper end of the tappet broken away to show the manner in which the lower end of the pushrod is accommodated in a socket at the upper of the tappet.

DETAILED DESCRIPTION OF THE DRAWINGS

Figure 1:
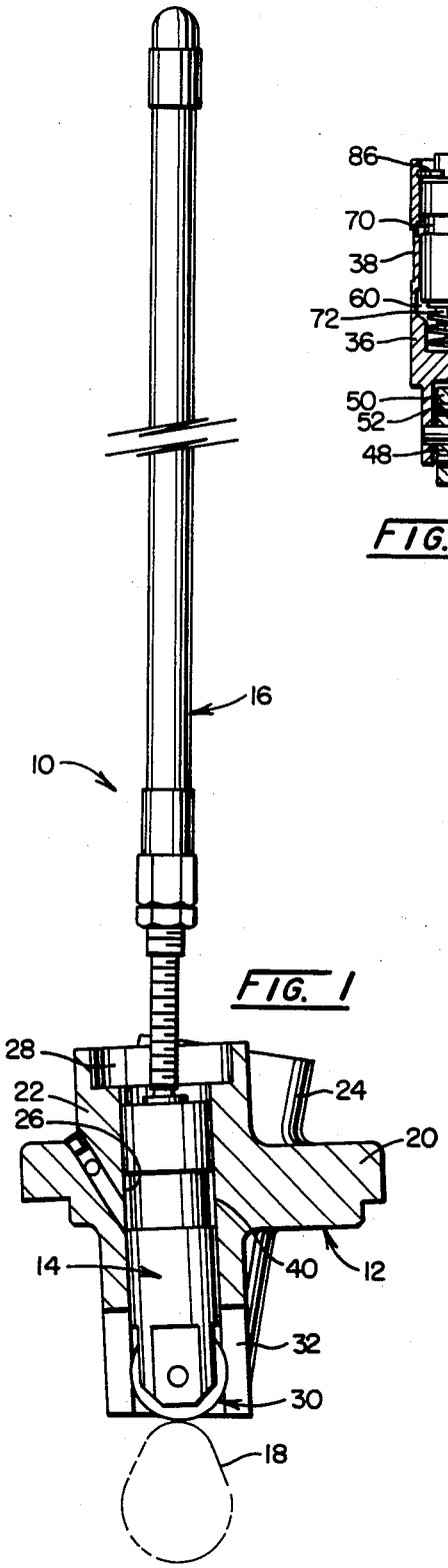
FIG. 1 of the accompanying drawings in an elevation of an instant valve lifter assembly looking along the axis of the associated camshaft, with part of the housing broken away to show one of its tappets and the lower end of the associated pushrod.

The preferred instant valve lifter assembly (generally designated 10) shown in FIG. 1 comprises three main parts, namely a housing (generally designated 12), two tappets (generally designated 14) and a pair of adjustable-length pushrod (generally designated 16). The valve lifter assembly is shown in FIG. 1 as it appears when mounted on a conventional pushrod-operated motorcycle engine, except that the front part of the housing is broken away to show the tappet 14 at the lower end of the pushrod 16. When thus mounted on the engine, the lower end of the tappet 14 rests in contact with a cam 18 (as is shown in broken lines in FIG. 1), while the upper end of the pushrod 16 is in contact with a rocker arm (not shown). Although, the complete instant valve lifter assembly actually includes two tappets and two pushrods, the second tappet is not visible in FIG. 1, while the second pushrod is omitted for the sake of clarity.

The housing 12 comprises an approximately trapezoidal flange 20 (the shape of this flange being best seen in FIG. 4) and two hollow cylindrical sections 22 and 24 respectively, each of which is integral with and extends through the flange 20. As shown in FIG. 1, the axes of the two cylindrical sections 22 and 24 are inclined at an angle of about 10° to each other in order to enable their associated pushrods to reach their respective rocker arms, but apart from this difference in inclination the two cylindrical sections are identical in form. Accordingly, hereinafter only the cylindrical section 22 will be described in detail since exactly corresponding features are present in the cylindrical section 24.

The cylindrical section 22 has an axial bore 26 extending therethrough, this axial bore having an enlarged section 28 at its upper end. The enlarged section 28, which is produced of course by counterboring, serves exactly the same function as the corresponding counterbore in a conventional housing of the same type, namely to receive the lower end of a shield and gasket (not shown) which in the assembled form of the engine fit around the pushrod and protect it from rain, dust and similar environmental hazards which might otherwise damage the pushrod. The associated tappet 14 is slideably disposed within the bore 26, and bears at its lower end a rotatable roller 30 which contacts the cam 18. The roller 30 is slightly larger in diameter than the bore 22, and to accommodate the roller 30 a slot 32 is cut across a diameter of the lower end of the front cylindrical section 22. To prevent the tappets 14 sliding out of the lower end of the bores 22 during assembly of the valve lifter assembly on the engine (as described below), a retaining member or key (not shown) is provided on the underside of the housing between the cylindrical sections 22 and 24, this retaining member having projections which extend into the bores 26, thus preventing the tappets from sliding out of the lower end of these bores.

Figure 2:
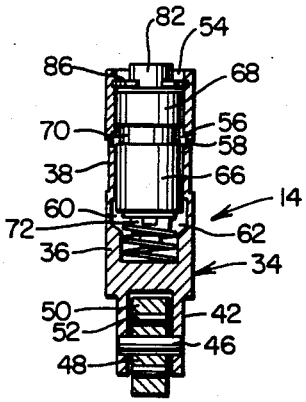
FIG. 2 is a front elevation of one of the tappets of the valve lifter assembly shown in FIG. 1 looking at right angles to the direction of FIG. 1 and with part of the body member broken away.
Figure 3:
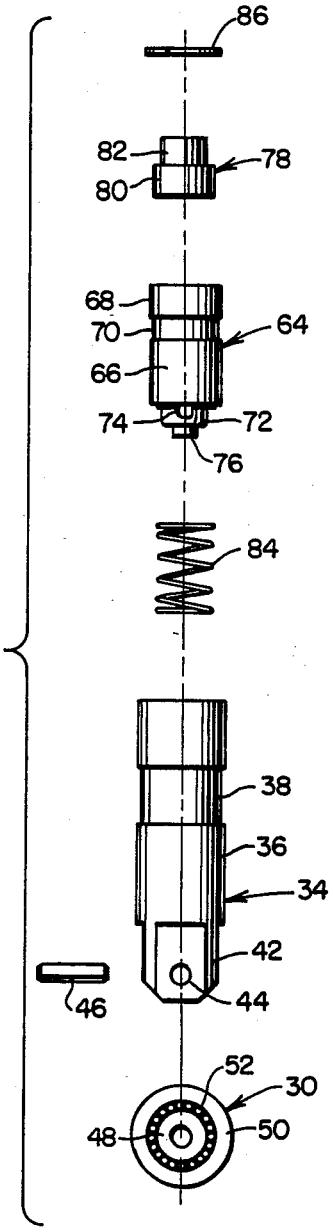
FIG. 3 is an exploded view of the tappet shown in FIGS. 1 and 2, the view being taken looking in the same direction as FIG. 1.

The tappets 14 will now be described in more detail with reference to FIGS. 2 and 3; FIG. 2 shows the tappet 14 as it is actually present in the engine, while FIG. 3 is an exploded view which shows more clearly the various parts of the tappet. As shown in FIGS. 2 and 3, the tappet 14 comprises a body member 34 having an upper cylindrical section 36. This cylindrical section 36 has a central section 38 of reduced diameter, the section 38 being formed of course simply by milling an annular groove completely around the cylindrical section 36. As may be seen from FIG. 1, the presence of this section 38 on the cylindrical section 36 ensures that, when the body member 34 is disposed within the bore 26 in the housing 12, a small annular chamber 40 is left between the walls of the body member 34 and the bore 26; this chamber 40 is provided for purposes of lubrication, as described in more detail below.

The body member 34 also comprises two parallel flanges 42 extending downwardly from the lower end face of the cylindrical section 36. Aligned bores 44 (only one of which is visible in FIG. 3) extend through the flanges 42, the common axis of the bores 44 being perpendicular to and extending through the axis of the cylindrical section 36. A pin 46 passes through both bores 44 and supports the roller 30 between the flanges 42. As shown in FIGS. 2 and 3, the roller 30 comprises an inner shell 48, an outer shell 50 and a roller race 52 disposed between the two shells 48 and 50. The cylindrical outer surface of the outer shell 50 forms a bearing surface which, as shown in FIG. 1, engages the cam 18.

As best seen in FIG. 2, the cylindrical section 36 of the body member 34 is hollow, the interior of the cylindrical section 36 forming a socket 54 which is closed at its base adjacent the lower end of the cylindrical section 36 but which opens to the upper end of the cylindrical section 36 (which is also, of course, the upper end of the body member 34). Although the socket 54 is basically cylindrical, the actual form of the socket is somewhat complicated. From the upper end of the cylindrical section 36, a cylindrical section of the socket 54 extends downwardly to a point adjacent the upper end of the section 38, except that a shallow groove is cut in the walls of the socket 54 close to the mouth of the socket. Adjacent the upper end of the section 38, the socket 54 is provided with a section 56 of increased diameter (formed by milling an annular groove in the cylindrical wall of the socket 54). A bore 58 extends from this enlarged section 56 through the wall of the section 38 to the exterior of the body member. This bore 58 serves to provide lubricating oil to the socket 54, as described in more detail below. Below the enlarged section 56, the socket 54 returns to its original diameter, which is such that the cylindrical section 36 of the body member 34 is a sliding fit in the socket 54, and continues at this diameter until a point just below the lower end of the section 38. At this point, the socket 54 is enlarged to form a cylindrical section 60 of enlarged diameter and then, below the section 60, a frusto-conical section 62 which tapers downwardly from the diameter of the section 60, which is larger than the diameter of the upper end of the socket 54, to a diameter which is less than that of the diameter of the upper end of the socket 54. The lowest part of the socket 54 is cylindrical and has a diameter equal to that of the narrow end of the frusto-conical section 62.

A hydraulic lifter, generally designated 64, is accommodated within the socket 54 in the body member 34. The hydraulic lifter 64 is a commercially-available unit manufactured by the Chevrolet Division of General Motors Corporation and originally intended for use on automobile engines. This hydraulic lifter is a type which will be familiar to automobile engineers, and comprises a hollow cylinder member 66 closed at its lower end and open at its upper end, and a piston member 68 slideably received within and closing the upper end of the hollow interior of the cylinder member 66. It should be noted that the design of this hydraulic lifter is such that the upper part of the piston member 68 is of larger diameter than the lower section 70 thereof, so that the upper section of the piston member and the cylinder member 66 are coaxial and of the same diameter. The lower end of the cylinder member 66 is provided with a cylindrical end section 72 of reduced diameter. This end section 72 having an aperture 74 extending diametrically therethrough. Although not shown in the drawings, a conduit extends upwardly through the base of the cylinder member 66, thereby establishing fluid communication between the aperture 74 and the interior of the hollow cylinder member 66, and a check valve is disposed in this conduit and arranged to permit fluid flow from the aperture 74 into the interior of the hollow cylinder member 66 but not in the reverse direction. Below the end section 72, the hydraulic lifter 64 is provided with a solid cylindrical abutment 76.

A cap member, generally designated 78, is slideably mounted on the piston 68 of the hydraulic lifter 64. The upper end of the piston member 68 has a cylindrical socket (see FIG. 9) formed therein. The cap member 78 comprises two coaxial cylindrical sections 80 and 82, the lower section having the form of a solid cylinder which is slideably received in the socket in the piston member 68, while the upper section 82, which is smaller diameter than the lower section 80, has formed in its upper surface a socket 83 (see FIG. 9) which accommodates the lower end of the pushrod 16.

As may be seen from FIG. 2, the dimensions of the body member 34 and socket 54 therein are arranged so that the cylinder member 66 and the upper part of the piston member 68 are a sliding fit in the upper part of the socket 54. A helical spring 84 is disposed between the base of the socket 54 and the shoulder formed where the end section 72 joins the main part of the cylinder member 66 of the hydraulic lifter, so that the hydraulic lifter and cap are biased upwardly by this spring 84. To prevent the hydraulic lifter and cap leaving the socket 84, an annular snap ring 86 is fitted into the groove cut adjacent the upper end of the socket 54; the central aperture in the snap ring 86 is sized so that the upper section 82 of the cap 78 can pass through this aperture, but the lower section 80 of the cap 78 cannot, nor can the piston 68 of the hydraulic lifter 64. It should be noted that, as shown in FIGS. 2 and 9, when the tappet 14 is assembled the upper end of the upper section 82 of the cap 78 only projects a very short distance above the upper end of the body member 34, so that the lowest part of the socket 83 actually lies within the socket 54 in the body member 34. Moreover, as shown in FIG. 9 and as explained below in more detail with reference to that figure below, when the tappet is in use and is in contact with the lower end of the pushrod 16, the length of the pushrod is adjusted so that there is a small clearance between the snap ring 86 on the one hand and the lower section 80 of the cap 78 and the upper end of the piston member 68 on the other, thereby still further reducing the projection of the upper section 82 out of the socket 54. The very limited projection of the upper, socket-carrying section 82 of the cap member 78 out of the socket 54 is in marked contrast to the very long extension of the socket-carrying section of the tappet beyond the body member in the conventional type of motorcycle valve lifter assemblies described above, and greatly reduces the vibration and noise previously associated with such conventional assemblies.

It will also be seen from FIG. 2, the enlarged section 56 of the socket 54 is disposed adjacent the reduced diameter section 70 of the hydraulic lifter, thereby leaving an annular chamber between the hydraulic lifter and body member 34 at this point. Also, the lower end of the cylinder member 66 projects downwardly part way into the section 60 of the socket 54 but terminates above the section 62 of the socket 54, thereby leaving a chamber defined by the lower end of the cylinder member 66, and the sections 60 and 62 and the lowest cylindrical section of the socket 54. Oil enters the bore 26 (FIG. 1) in a manner to be described below, passes through the bore 58 and into the annular chamber left between the walls of the section 56 of the socket 54 and the section 70 of the hydraulic lifter. Because of the sliding fit of the cylinder member 66 within the socket 54, and the oscillation of the hydraulic lifter within the socket 54 as the engine turns, the oil moves from the annular chamber past the cylinder member 66 to the chamber at the lower end of the hydraulic lifter, eventually filling this chamber with oil and allowing oil to pass through the aperture 74 in the end section 72 of the hydraulic lifter past the check valve and up into the interior chamber of the hydraulic lifter, so that the hydraulic lifter can increase in length and adjust the valve clearance in the conventional manner. It should be noted that the diameters of the main section of the cylinder member 66 and the end section 72 thereof are such that the end section 72 can enter the lowest, cylindrical section of the socket 54 but the main part of the cylinder member 66 cannot. This helps to prevent damage to the hydraulic lifter if, as a result of improper adjustment of the length of the pushrod, the hydraulic lifter is inadvertently forced too far downwards into the socket 54.

The housing 12 will now be described in more detail with reference to FIGS. 4–6. As mentioned above, the housing 12 comprises a substantially trapezoidal flange 20 and two cylindrical sections 22 and 24 integral with and extending through the flange 20. As shown in FIG. 4, the flange 20 has a left side edge 90, a right side edge 92, a front edge 94 and a rear edge 96. (The housing 12 shown in the drawings in the housing associated with the rear cylinder of a conventional pushrod-operated twin cylinder motorcycle engine which, as those skilled in the art are aware, is mounted so that the front of the motorcycle is to the left in FIG. 4. As those familiar with this type of engines will be aware, the housing for the front cylinder is not exactly the same as the housing for the rear cylinder, nor is it exactly a mirror image thereof. However, from the following description of the housing 12 for the rear cylinder, it is believed that those skilled in the art will have no difficulty applying the invention to the front cylinder housing.) The cylindrical section 22 is disposed adjacent the edge 90, while the rear cylindrical section 24 is disposed adjacent the right edge 92. The flange 20 is provided with four bores 98 one located adjacent each corner of the flange, these bores 98 being used to accommodate the bolts used to attach the flange 20 to the remaining parts of the motorcycle engine. Counterbores 100 are drilled from the upper surface of the flange 20 coaxial with each of the bores 98, so that the counterbores form in effect enlarged sections of the bores 98.

The housing 12 is designed so that it can be used as a direct replacement for the corresponding rear cylinder housing of a conventional Harley-Davidson pushrod-operated motorcycle engine. Accordingly, the housing is provided with an oil inlet port 102 located on the underside of the flange between the cylindrical section 22 and the left edge 90 of the flange, this location of the oil inlet port being determined by the design of the remaining parts of the engine. However, the arrangement of oilways or conduits within the flange is very different from those in the conventional housing described above. From the oil inlet port 102, a first bore 104 (see FIG. 6) extends upwardly through approximately one-half the thickness of the flange. A second bore 106 is drilled from the edge 94 of the flange to intersect the upper end of the bore 104. For most of its length, the second bore 106 has the same diameter (0.156 inches, 3.96 mm.) as the first bore 104. However, the bore 106 has a first enlarged section 108 adjacent the edge 94 of the flange, and a second, further enlarged section 110 extending inwardly from the intersection of the bore 106 with the edge 94. The section 110 has a diameter of 0.25 inches (6.35 mm.).

A third bore 112 is drilled from the right edge 92 of the flange 20 to intersect the second bore 106. This third bore is generally similar in form to the second bore, having, for most of its length, a diameter equal to the diameter of the first bore 104, having a first enlarged section 114 adjacent the right edge 92, and a second, further enlarged section 116 extending a short distance inwardly from the intersection of the bore 112 with the edge 92. Conveniently, the section 114 has the same diameter as the section 108 and the section 116 has the same diameter as the section 110.

A fourth bore 118, best seen in FIG. 5, is drilled from the upper surface of the flange 20 downwardly and towards the axis of the bore 26 in the cylindrical section 22 so that it passes through the intersection of the second and third bores 106 and 112 respectively and so that its lower end opens into the bore 26 in the cylindrical section 22. A fifth bore 120 is similarly drilled from the upper surface of the flange 20 downwardly and toward the axis of the bore 26 in the cylindrical section 24 so that it intersects the third bore 112 and so that the lower end opens into the bore 26 in the cylindrical section 24.

To prevent oil emerging from the ends of the second, third, fourth and fifth bores, the end of the second bore emerging from the edge 94 of the flange, the end of the third bore 112 emerging from the edge 92 of the flange, and the upper ends of the fourth and fifth bores are all plugged. Plugging of the second and third bores 106 and 112 respectively is effected by tapping the sections 108 and 114 thereof, and engaging set screws (not shown in the drawings) in these threaded sections 108 and 114. The upper ends of the bores 118 and 120 closed by simple plugs 122, only the plug for the bore 118 being visible in FIG. 5.

The housing 12 is designed so that, like conventional housings of the same type, it can be cast in a single piece and then bored to the correct form. To facilitate casting, and to make the final housing rugged, the junction between the flange 20 and the cylindrical sections 22 and 24 are radiused, as best seen at points 124 in FIG. 5. In a conventional housing of this type, the cylindrical sections 22 and 24 are formed as two hollow cylinders partially fused together, so that the line of junction between the cylindrical sections and the upper surface of the flange 20 has approximately the form of a FIG. 8. However, in the housing shown in FIGS. 1 and 4–6, the form of the cylindrical sections is altered so that the line of junction between the cylindrical sections and the upper surface of the flange has the form of a rectangle, one pair of sides of which are surmounted by semi-circles, so that on either side of the pair of cylindrical sections there is a straight section of the line of junction. The radiusing along these straight sections of the line of junction creates in effect a linear trough and, as best seen in FIG. 5, the fourth and fifth bores 118 and 120 respectively are drilled into the bottom of this trough. This facilitates drilling of the bores 118 and 120. Also, the third bore 112 run substantially parallel to one of the straight sections of the line of junction thereby providing a constant, relatively large thickness of metal above the bore 112.

The preferred instant pushrod will now be described in greater detail with reference to FIGS. 1 and 7–9. As shown in FIGS. 1, 7 and 8, the instant pushrod comprises an elongate, approximately cylindrical shaft. The main part of this shaft comprises a hollow, completely cylindrical shaft body 126 which is formed of an isotropic carbon fiber/polymer composite. The use of such a carbon fiber composite greatly reduces the mass of the pushrod and increases its strength and resistance to flexing. However, since such a composite has a low resistance to abrasion, the composite cannot be allowed to come into contact with the tappet or the rocker arm and thus the shaft body 126 does not extend to the extreme ends of the rocker arm. The upper end of the shaft body 126 is provided with a cover 128 formed of metal; this cover has the form of a hollow cylinder extending around the outside of the upper portion of the shaft body 126, and a inwardly-extending annular flange which covers the upper end face of the cylindrical shaft body 126. A cap 130 has an upper section 132 having the form of a squat cylinder surmounted by a hemisphere, the radius of both the cylinder and the hemisphere being the same as that of the shaft body 126, and the base of the cylinder resting on the upper surface of the flange of the cover 128. The hemispherical surface of the section 132 acts as a bearing surface by means of which the pushrod is, in use, engaged with a rocker arm of the engine. The cap 130 also comprises a cylindrical lower section which extends downwardly from the lower end of the section 132 into the hollow interior of the shaft body 126, the section 134 being a tight fit within the shaft body 126.

At the lower end of the shaft body 126, the pushrod 16 is provided with a lower cap, generally designated 136. This lower cap 136, which is formed of metal, has an upper section 138 in the form of a thin, hollow cylinder which provides a cylindrical socket which receives the lower end of the shaft body 126. The lower cap 136 also comprises a lower section 140 having the form of a hexagonal prism coaxial with the upper section 138. Obviously, the hexagonal prismatic form of the lower section 140 provides three pairs of flat, parallel surfaces on opposed sides thereof so that any one of the pairs of flat parallel surfaces can be grasped by a wrench and the shaft thereby rotated by means of the wrench.

The lower section 140 of the lower cap 136 is provided with a threaded axial bore, which provides an internally screw-threaded socket. This bore or socket receives the upper, threaded end of an adjusting member, generally designated 142.

The adjusting member 142 has five sections, all coaxial. The first, uppermost section 144 is cylindrical and threaded throughout its whole length and is engaged with the socket in the lower cap 136. The second section 146 of the adjusting member is also threaded throughout its entire length and has the form of a cylinder of the same diameter as the section 144 but cut away by a pair of flat parallel surfaces on opposed sides of the section 146. These flat parallel surfaces enable the adjusting member to be grasped by a wrench and thus rotated. The third section 148 of the adjusting member 142 is cylindrical but unthreaded and has a diameter less than that of both the section 146 and the further section 150 described below. The last two sections of the adjusting member are a squat unthreaded cylindrical section 150 lying adjacent the section 148 and a fifth hemispherical section 152 surmounting the lower end face of the section 150 and having the same diameter as the section 150, this diameter being no greater than the distance between the pairs of flat, parallel surfaces on the section 146. The hemispherical surface of the section 152 of the adjusting member 142 acts as a bearing surface, being in contact with the socket 83 of the tappet, as best seen in FIG. 9.

As will be apparent to those skilled in the art, the threads on the sections 144 and 146 of the adjusting member, coupled with the flat parallel surfaces on the section 146 and the hexagonal section 140 provided on the shaft, enable the sections 140 and 146 to be simultaneously grasped by two wrenches and the adjusting member and shaft rotated relative to one another so that the adjusting member can be screwed into and out of the socket in the section 140, thereby enabling the overall length of the pushrod to be adjusted. (As shown in FIG. 8, the dimensions of the shaft body 126 and the sections 144 and 146 of the adjusting member 142 are arranged so that the upper end of the section 144 can if necessary extend up into the hollow interior of the shaft body 126. However, because the carbon fiber composite used for the shaft body 126 cannot easily be threaded, the interior of the shaft body 126 is not threaded, engagement between the adjusting member and the shaft being effected solely by the threaded bore in the section 140.) A threaded locknut 154 is engaged on the section 144 of the adjusting member 142 and can be rotated relative to the adjusting member until it abuts the lower end face of the section 140 of the shaft, thereby enabling the shaft and adjusting member to be locked in position relative to one another, and the length of the pushrod thus fixed.

To assemble the valve lifter assembly shown in FIG. 1, the tappets 14 are dropped into the bores 26 in the cylindrical sections 22 and 24 of the housing and the housing then fixed by means of bolts passed through the bores 98 (FIG. 4) in position on the engine. This causes the oil inlet port 102 (FIGS. 4 and 6) to mate with an oil supply line provided on the engine housing (not shown). To place the pushrods 16 in position, each pushrod in turn is adjusted so that its locknut 154 is spaced from the lower end of each shaft, and its adjusting member is screwed well into its shaft, so that the overall length of the pushrod is considerably less than the distance between the upper end of the associated tappet 14 and the associated rocker arm (not shown). The pushrod is then placed between the tappet and the rocker arm, wrenches engaged with the sections 140 and 146 of the pushrod and the adjusting member rotated relative to the shaft until the length of the pushrod is increased so that the pushrod is firmly held with its section 132 engaged with the rocker arm, its section 152 engaged in the socket 83 (FIG. 9) of the tappet 14 and the correct valve clearance has been obtained. It should be noted that FIG. 1 shows the valve lifter assembly with the roller 30 resting on the lobe of the cam 18, and thus in the valve-open position in which the tappet 14 and the pushrod 16 are in their highest positions relative to the housing 12. As previously mentioned, final adjustment of the length of the pushrod must be made with the valve lifter assembly in the valve-closed position, in which the roller 30 is not in contact with the lobe of the cam 18, so that the tappet and pushrod are located much lower relative to the housing 12. Thus, during final assembly of the pushrod, the socket-carrying section of the cap 78 which accommodates the lower end of the pushrod is a substantial distance below the upper end of the bore 26 in the housing and is thus inaccessible to a wrench. It is only the provision of the flat, parallel surfaces on the section 146 of the adjusting member 142 of the pushrod which permits manipulation of the adjusting member by a wrench during final adjustment of the length of the pushrod.

At this point, as shown in FIG. 9, the thrust exerted by the valve spring on the pushrod is such that the upper end of the section 80 of the cap 78 on the tappet 14 is spaced a short distance below the snap ring 86, the force of the valve spring transmitted through the pushrod being sufficient to hold the cap 78 clear of the snap ring 86 against the bias provided by the spring 84. Finally, while the shaft and the adjusting member are held fixed relative to one another, the locknut 154 is rotated around the adjusting member until it engages the lower end of the section 140 of the shaft, thereby locking the adjusting member and shaft relative to one another and fixing the length the pushrod. As shown in FIG. 9, once the assembly operation has been completed, the lower end of the pushrod actually enters into the upper end of the body member 34 of the tappet, while the undercut section 148 of the adjusting member 142 avoids contact between the walls of the adjusting member and the rim of the socket 83 in the upper section 82 of the cap 78. (The angle between the axes of the tappet and the adjusting member is exaggerated in FIG. 9 for the sake of ease of illustration.)

As already mentioned, the provision of the flat, parallel surfaces on the section 146 of the adjusting member 142 enables the section 146 to be grasped by a wrench during final adjustment of the length of the pushrod. However, the provision of these flat, parallel surfaces on the section 146 has the further advantage that it enables the adjusting member to be screwed further into the shaft; if one attempted to modify a conventional pushrod by placing the nut section further away from the lower end of the pushrod (so that the nut section could be grasped by a wrench even though the lower end of the pushrod was inaccessible because it was deep within the bore in the housing in the valve-closed position), this would greatly limit the extent to which the adjusting member could be screwed into the shaft, since the nut section would not be able to enter the socket in the shaft. This is highly undesirable, since it would necessitate the use of a considerably shorter shaft and a longer adjusting member. In practice, one wishes to make the shaft as long as possible and the adjusting member as short as possible, for two reasons. Firstly, since the shaft has the form of a thin hollow cylinder, whereas the adjusting member is effectively a solid cylinder, for any given material and given resistance to deformation, the weight per unit length of the shaft can be made much lower than that of the adjusting member. Secondly, the form of shaft used in the preferred embodiment of the invention described above enables the main part of the shaft to be formed of a lightweight carbon fiber composite, whereas the adjusting member must in practice be formed of metal to allow proper milling and threading of the adjusting member. The pushrod 16 shown in the drawings allows the adjusting member 142 to be screwed into the shaft until only the extreme lower end of the section 146 is exposed (note that because of the relative diameters of the sections 146, 148, 150 and 152, a wrench can be slipped over the sections 152, 150 and 148 so as to manipulate the exposed extreme lower end of the section 146), thereby reducing to a minimum the length of the adjusting member needed to fit into any particular engine and maximizing the length of the relatively lightweight shaft.

It will be apparent to those skilled in the art that numerous changes and modifications can be made in the preferred instant valve lifter assembly described above without departing from the scope of the invention. Accordingly, the whole of the foregoing description is to be construed in an illustrative and not a limitative sense, the scope of the invention being defined solely by the appended claims.

What is claimed is:

1. A valve lifter assembly comprising a housing, two pushrod lifter assemblies accommodated in said housing, and two pushrods one engaged with each of said pushrod lifter assemblies, said housing comprising a flange having first, second and third edges, said first and third edges lying on opposed sides of said flange and said second edge connecting said first and third edges, and first and second hollow cylindrical sections integral with an extending through said flange, said first cylindrical section adjacent said first edge of said flange and said second cylindrical section lying adjacent said third edge of said flange, said housing having walls defining an oil inlet in the underside of said flange between said first cylindrical section and said first edge of said flange, said housing also having walls defining:

a first conduit extending upwardly from said oil inlet into said flange;

a second conduit extending from said first conduit to said second edge of said flange;

a third conduit extending from said second conduit to said third edge of said flange;

a fourth conduit extending from the upper face of said flange to the interior of said first hollow cylindrical section, said fourth conduit intersecting at least one of said second and third conduits; and a fifth conduit extending from the upper face of said flange to the interior of said second hollow cylindrical section, said fifth conduit intersecting said third conduit, said housing being provided with plugging means (1) which block said second conduit between its intersection with said third conduit and said second edge of said flange, (2) which block said third conduit between its intersection with said fifth conduit and said third edge of said flange, (3) which block said fourth conduit between said upper surface of said flange and its intersection with said at least one of said second and third conduits, and (4) which block said fifth conduit between said upper surface of said flange and its intersection with said third conduit, one of said pushrod lifter assemblies being slidably disposed within each of said two cylindrical sections of said housing, and each of said pushrod lifter assemblies comprising:

a body member having, at its lower end, a bearing surface for engaging a cam, said body member having walls defining a socket closed at its base but open to the upper end of said body member;

a hydraulic lifter slideably disposed within said socket, said hydraulic lifter comprising a hollow cylinder member closed at its lower end and disposed at the lower end of said hydraulic lifter so as to define a chamber between the lower end of said hollow cylinder member and the lower end of said socket, said hollow cylinder having walls defining a conduit extending from said chamber to the interior of said hollow cylinder member, a check valve disposed in said conduit and arranged to permit fluid flow from said chamber via said conduit into said interior of said hollow cylinder member but not in the reverse direction; and a piston slideably received within and closing the upper end of said hollow interior of said hollow cylinder member;

biasing means for biasing said lower end of said hollow cylinder member away from said lower end of said socket;

means for supplying oil to said chamber; and a cap member slidably mounted on said piston of said hydraulic cylinder, said cap member being provided with a socket in which in received the lower end of one of said pushrods, each of said pushrods comprising a shaft having at its one end walls defining an internally screw-threaded socket, an adjusting member having a screw-threaded section extending from its one end, said screw-threaded section being engaged with said socket so that said one end of said adjusting member can be screwed into and out of said socket, thereby enabling the length of said pushrod to be adjusted, said adjusting member having , at its opposed end, a non-threaded section having a bearing surface engaged with the socket of the cap member of its associated pushrod lifter assembly, said threaded section of said adjusting member having a pair of substantially flat, parallel surfaces on opposed sides thereof so that said flat, parallel surfaces can be grasped by a wrench and said adjusting member rotated by said wrench, and a locknut engaged with said screw-threaded section of said adjusting member so as to be capable of being abutted against the lower end of said shaft, thereby locking said adjusting member in position relative to said shaft.

2. An assembly according to claim 1 wherein the body member of each of said pushrod lifter assemblies has a central section of reduced cross-section so as to leave an annular chamber between said central section of said body member and the internal wall of the hollow cylindrical section of said housing in which said body member is accommodated, and wherein the ends of said fourth and fifth conduits in communication with the interiors of said hollow cylindrical sections of said housing communicate with said annular chambers.

3. An assembly according to claim 1 having the bearing surfaces of the body members of its pushrod lifter assemblies engaged with two cams, the upper ends of its pushrods engaged with two rocker arms and the locknuts of its pushrods abutted against the lower ends of their associated shafts so that the adjusting members of said pushrods are locked in position relative to their associated shafts, the body members of said pushrod lifter assemblies being provided with retaining means arranged to prevent said cap members from leaving said sockets in said body members of said pushrod lifter assemblies, and the positions of said adjusting members relative to their associated shafts being arranged so that both of said cap members are spaced from their associated retaining means.

4. An assembly according to claim 1 wherein said flat, parallel surfaces on each said adjusting member do not extend to said one end of said adjusting member so that said one end of said adjusting member has a completely cylindrical threaded section adjacent said one end thereof.

5. An assembly according to claim 1 wherein each said adjusting member bearing surface comprises a hemispherical surface at said opposed end of said adjusting member.

6. An assembly according to claim 5 wherein said adjusting member has an unthreaded cylindrical section adjacent said hemispherical bearing surface, said cylindrical section having the same diameter as said hemispherical surface so that said hemispherical surface surmounts one end face of said cylindrical section.

7. An assembly according to claim 6 wherein an undercut section is provided on each said adjusting member between the portion of said pushrod including said bearing surface and said threaded section of said pushrod, said undercut section being of smaller cross-section than said portion including said bearing surface and said threaded section.

8. An assembly according to claim 1 wherein each said adjusting member comprises five sections, namely:

(1) a cylindrical threaded section adjacent said one end of said pushrod;

(2) a second threaded section adjacent said section (1), said second section having the form of a cylinder of the same diameter as section (1) but cut away to form said substantially flat, parallel surfaces on opposed sides thereof;

(3) a third, unthreaded cylindrical undercut section lying adjacent said second section and having a diameter less than said second section;

(4) a fourth, unthreaded cylindrical section lying adjacent said third section and having a diameter greater than said third section, said sections (1)–(4) all being coaxial with one another; and (5) a fifth, hemispherical section surmounting the end face of said fourth section remote from said third section and having the same diameter as said fourth section, the hemispherical surface of said fifth section forming said bearing surface.

9. An assembly according to claim 1 wherein each said shaft comprises:

a hollow cylindrical body member formed of a carbon-fiber composite; and an end cap on the other end of each said pushrods, said end cap having a socket in which is fixedly received the opposed end of said body member, said end cap having a bearing surface for coaction with a rocker arm.

* * * * *